US009637973B1

(12) United States Patent
Berman et al.

(10) Patent No.: US 9,637,973 B1
(45) Date of Patent: May 2, 2017

(54) HEMBAR GUIDE CABLE FINIAL

(71) Applicant: MECHOSHADE SYSTEMS, INC., Long Island City, NY (US)

(72) Inventors: Glen Berman, Rockville, MD (US); Xi Ming Liarno, Brooklyn, NY (US); Eugene Miroshnichenko, Oceanside, NY (US)

(73) Assignee: MECHOSHADE SYSTEMS, INC., Long Island City, NY (US)

( * ) Notice: Subject to any disclaimer, the term of this patent is extended or adjusted under 35 U.S.C. 154(b) by 0 days.

(21) Appl. No.: 14/955,671

(22) Filed: Dec. 1, 2015

(51) Int. Cl.

| | |
|---|---|
| ***A47H 3/00*** | (2006.01) |
| ***A47H 15/00*** | (2006.01) |
| ***E06B 3/00*** | (2006.01) |
| ***E06B 9/58*** | (2006.01) |

(52) U.S. Cl.
CPC ..... *E06B 9/58* (2013.01); *E06B 2009/583* (2013.01)

(58) Field of Classification Search
CPC ..... E06B 2009/583; E06B 9/58
See application file for complete search history.

(56) References Cited

U.S. PATENT DOCUMENTS

| | | | | | |
|---|---|---|---|---|---|
| 471,114 | A | * | 3/1892 | Haswell | E06B 9/58 160/277 |
| 1,797,162 | A | * | 3/1931 | Stuber | E06B 9/58 160/277 |
| 2,438,101 | A | | 3/1948 | Wright | |
| 2,572,847 | A | * | 10/1951 | Ehret | E06B 9/58 160/279 |
| 4,967,824 | A | | 11/1990 | Colson et al. | |
| 5,306,885 | A | | 4/1994 | Utke | |
| 6,918,425 | B2 | | 7/2005 | Nien | |
| 7,000,672 | B2 | | 2/2006 | Nien | |
| 8,270,152 | B2 | | 9/2012 | Haigh | |
| 2013/0000087 | A1 | | 1/2013 | Finckh-Jung et al. | |
| 2013/0233500 | A1 | | 9/2013 | Chen | |
| 2014/0138036 | A1 | | 5/2014 | de Vries et al. | |

FOREIGN PATENT DOCUMENTS

| | | |
|---|---|---|
| CH | 702 766 | 8/2011 |

* cited by examiner

*Primary Examiner* — Katherine Mitchell
*Assistant Examiner* — Jeremy Ramsey
(74) *Attorney, Agent, or Firm* — Snell & Wilmer L.L.P.

(57) ABSTRACT

The system includes a finial that is configured to be removed from a guide cable, while the guide cable is still connected on both ends. The hembar includes a finial on each end, wherein the first finial includes an external channel at an angle and the second finial includes an external channel with an opposite angle. The hembar is rotated in order to receive the guide cable into the external channel, then reverse rotated so the guide cable translates in an internal channel. The system eliminates or reduces the need for a guide cable to be threaded through an eyelet on the finial of the hembar. The system eliminates or reduces the need to detach a cable, prior to uninstalling the shade system.

17 Claims, 5 Drawing Sheets

HEMBAR GUIDE CABLE FINIAL

FIELD

This disclosure relates to window shade components, and more particularly, to a hembar with a finial that more easily allows a guide cable to be attached and detached.

BACKGROUND

In a window shading system, a guide cable 125 is used to control the unwanted movement of a hembar 100, and limit the hembar 100 movement along a vertical path. The hembar 100 usually attaches to the bottom of a fabric shade, wherein the top of the shade is connected to a roller that lifts the shade by rolling the shade around the roller. As set forth in prior art FIG. 1, a typical hembar 100 arrangement includes a finial 110 attached on each end of the hembar 100, wherein an eyelet 120 is attached to the outer end of the finial 110. The eyelet 120 receives the guide cable 125 such that, when the hembar 100 is raised vertically, the guide cable 125 restricts the horizontal movement of the hembar 100. One skilled in the art will appreciate that a shade system may also be mounted horizontally (e.g., roof of a greenhouse), so the hembar 100 could move horizontally with eyelets 120 restricting vertical movement. In fact, the shading system may be mounted at any angle, so the movements would be relative to the mounting position.

When initially installing a roller shade or replacing a roller shade, the roller shade would need to be installed first, then each guide cable 125 would need to be threaded through the eyelets 120. The guide cable 125 would then need to be attached to an upper surface and a lower surface. To confirm that the guide cable 125 is securely attached, the guide cable 125 would be affixed with a strong fastener that may not be easily accessible or easily removable. Similarly, the roller shade may need to be released, for example, to change the fabric or to fix a part. Because the guide cables 125 are threaded through the eyelets 120 on each end of the hembar 100, the hembar 100 could not be removed without first detaching the guide cables 125. Detaching the guide cables 125 often involved entering the ceiling, removing panels, avoiding wiring, and/or entering a lower crawl space.

SUMMARY

In various embodiments, a window shading system comprises a hembar coupled to a window shade, wherein the hembar has a first end and a second end, a first finial coupled to the first end of the hembar, wherein the first finial includes an external first slot configured to receive a guide cable, wherein the first slot is angled at a first angle; a second finial coupled to the second end of the hembar; wherein the second finial includes an external second slot configured to receive a guide cable, wherein the second slot is angled at a second angle; a first guide cable reciprocally received in the first finial; and a second guide cable reciprocally received in the second finial.

The first guide cable may not be parallel to the first angle and the second guide cable is not parallel to the second angle. The first angle and the second angle may be mirror images. The first angle or the second angle may be curved. The first angle or the second angle may be "S" shaped. The first finial is configured to be removed from the first guide cable, while the first guide cable is still connected on both ends. A portion of the first guide cable may be concealed within the first finial. The first finial includes an internal first channel configured to receive the guide cable, wherein the guide cable is configured to translate within the internal first channel. The first finial is configured to be twisted a first direction to receive the first guide cable, and the second finial is configured to be twisted a second direction to receive the second guide cable. The window shade may be at least one of a roller shade, an awning or a roof shade.

A method for inserting a guide cable into a finial may comprise rotating a hembar a first angle to align a first external slot with a first guide cable, wherein the first external slot is on a first finial, wherein the first finial is on a first end of the hembar; reciprocally receiving the first guide cable through the first external slot; reverse rotating the hembar to align the first guide cable with a first internal channel inside the first finial; rotating a hembar a second angle to align a second external slot with a second guide cable; wherein the second external slot is on a second finial, wherein the second finial is on a second end of the hembar; reciprocally receiving the second guide cable through the second external slot; and reverse rotating the hembar to align the second guide cable with a second internal channel inside the second finial.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
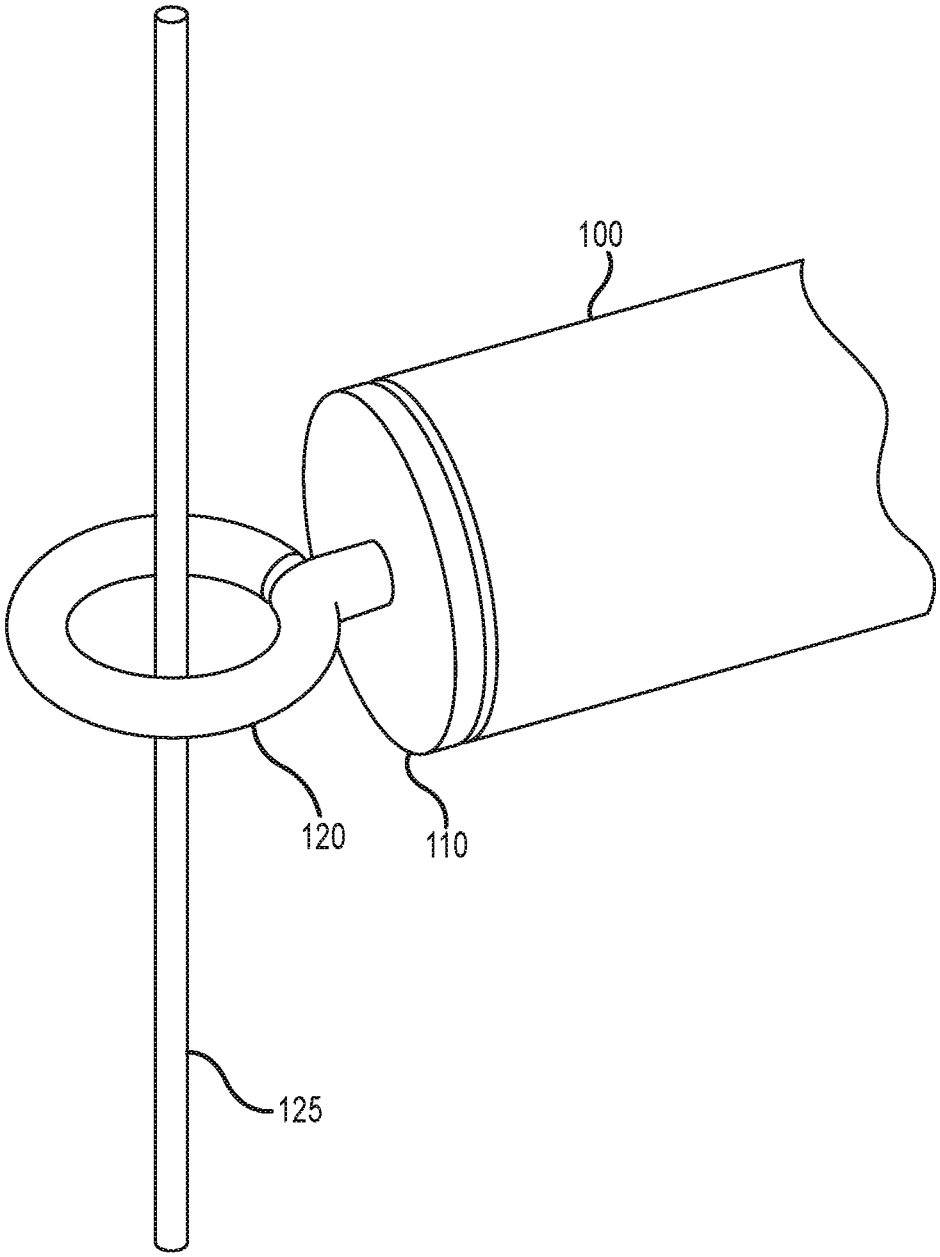
FIG.1 (PRIOR ART)
FIG. 1 illustrates a prior art system using an eyelet to attach a guide cable to a hembar finial.

The detailed description of exemplary embodiments herein makes reference to the accompanying drawings, which show embodiments by way of illustration. While these embodiments are described in sufficient detail to enable those skilled in the art to practice the inventions, it should be understood that other embodiments may be realized and that logical, chemical, and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. As used herein, phrases such as "make contact with," "coupled to," "touch," "interface with" and "engage" may be used interchangeably. Different cross-hatching may be used throughout the figures to denote different parts but not necessarily to denote the same or different materials.

The system eliminates or reduces the need for a guide cable 220 to be threaded through an eyelet on the finial 210 of the hembar 200. The system also eliminates or reduces the need to attach a cable after installing the shade system. The system further eliminates or reduces the need to detach a cable, prior to uninstalling the shade system. The system is also configured to partially or fully conceal at least a portion of the guide cables 220 within the finial 210. The finial 210 may also cover a portion of the guide cable 220, which may provide some protection for a portion of the guide cable 220. Finial 210 may also help avoid other objects from getting lodged into the system, which may occur in prior art systems between the guide cable 12 and the eyelet 120.

The system may also reduce unwanted hembar 200 movement (e.g., horizontal movement, wobble, racking, out of level, etc) which may cause the hembar to lock up on the guide cable. The system may also reduce unwanted hembar 200 movement by providing a narrow opening (slots) and/or longer channel for guide cable 220 to travel through (e.g., in contrast with the prior art eyelet 120 which often includes a larger circular opening). The system provides a non-twisting (or reduced twisting) channel guide inside the finial that prevents or restricts hembar 200 from wracking at an angle. The longer channel is the component that may resist the racking of the hembar 200 and the locking-up on guide cable 220.

Figure 3:
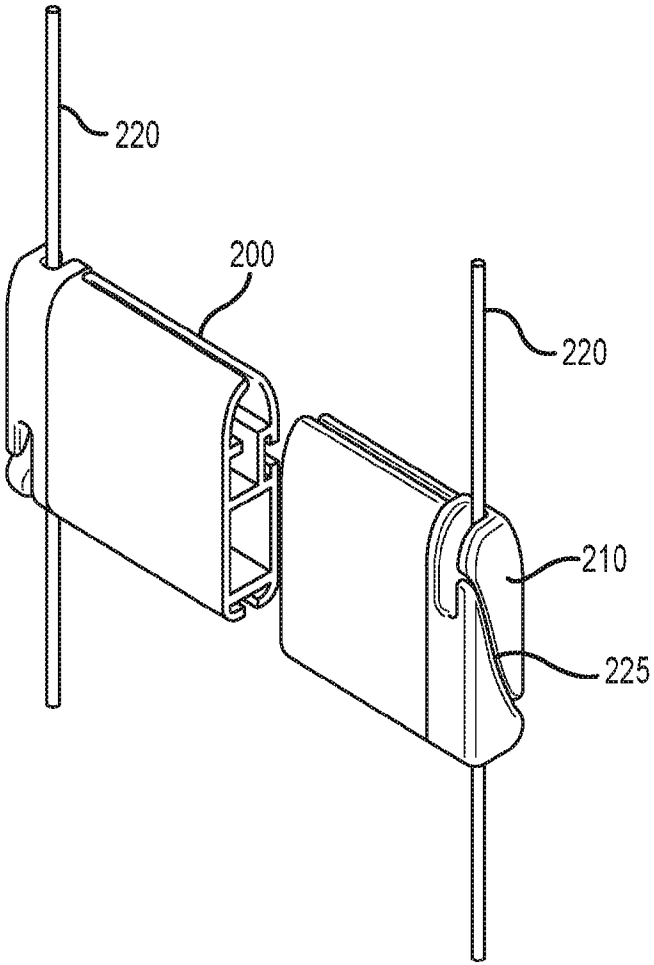
FIG. 3 illustrates a perspective view of a second side of a hembar with finials and guide cables, in accordance with various embodiments.
Figure 2:
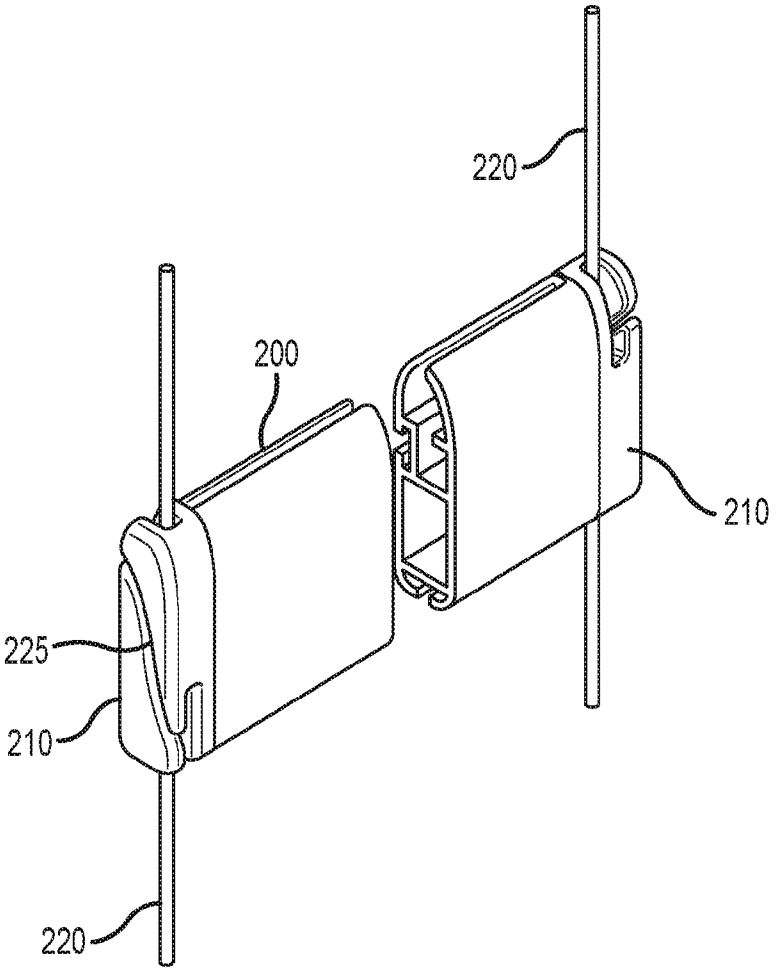
FIG. 2 illustrates a perspective view of a first side of a hembar with finials and guide cables, in accordance with various embodiments.
Figure 4:
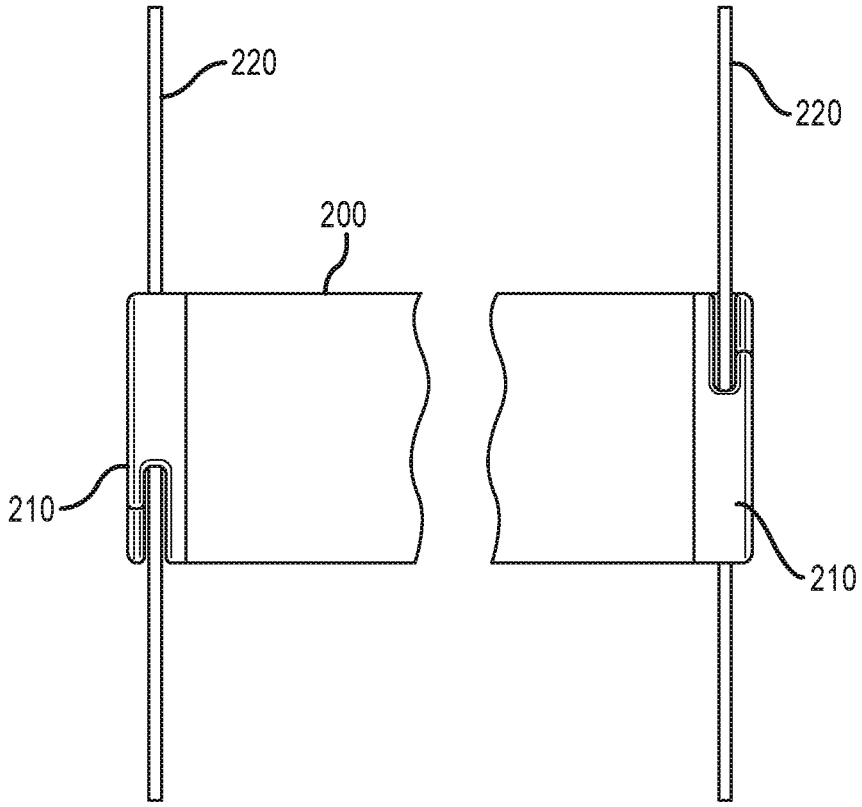
FIG. 4 illustrates a front view of a hembar with finials and guide cables, in accordance with various embodiments.

With respect to FIGS. 2-4, in various embodiments, the system may include a hembar 200, a finial 210 and a guide cable 220.

The system may be part of a shade system. The shade system may include any type of shade or window covering of various sizes and types. The shade may be any covering, such as a window shade, awning, roof shade and/or the like. The shade may be louvered blinds, fabric blinds, pleated blinds, roman shades, venetian blinds and/or the like. For example, the shade may be part of a roller shade system, wherein the shade is rolled up onto a roller bar and rolled off the roller bar to distribute a portion or all of the shade over an area such as a window opening. The shade system may be horizontal, vertical, sloping and/or tilted. Similar to above, one skilled in the art will appreciate that a shade system may also be mounted horizontally (e.g., roof of a greenhouse), so the hembar 100 could move horizontally with finial 210 restricting vertical movement. In fact, the shading system may be mounted at any angle, so the movements (horizontal, vertical, etc, as discussed herein) would be relative to the mounting position.

Hembar 200 may be any device attached to a shade. Hembar 200 provides weight and stability to the end of the shade. Hembar 200 may be located at an end of a shade, any location along a shade, along any side of a shade, between multiple shades, or any other position. Hembar 200 may be comprised of metal, wood, plastic, aluminum, titanium, alloy, fabric or any other suitable material.

Finial 210 may be removably or permanently attached to hembar 200. Finial 210 may be attached to an end of hembar 200, and in various embodiments, a finial 210 may be attached to each end of hembar 200. Finial 210 may be any shape. In various embodiments, the outside of finial 210 may have a similar outline as hembar, such that finial 210 and hembar 200 form a smooth transition when connected. Finial 210 may be comprised of metal, wood, plastic, aluminum, titanium, alloy, fabric, or any other suitable material.

Finial 210 may include a first side and a second side. The first side of finial 210 may include an external opening 225, as shown in FIGS. 2-3. The second side of finial 210 may be configured to connect to an end of hembar 200. In various embodiments, the second side of finial 210 is reciprocally received into the end of hembar 200.

Figure 6:
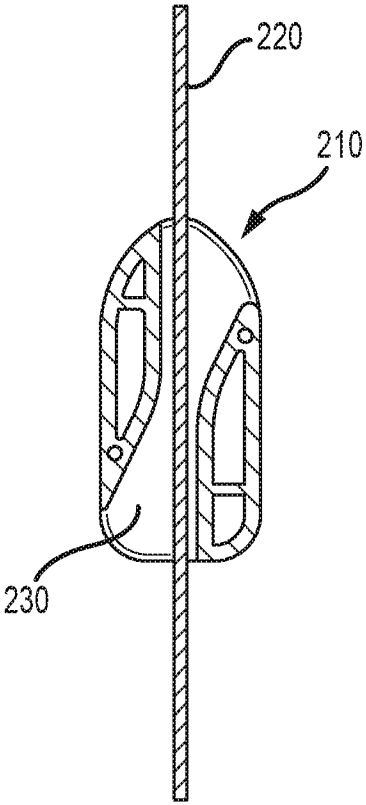
FIG. 6 illustrates a cut-away view of a heavy duty finial, in accordance with various embodiments.
Figure 7:
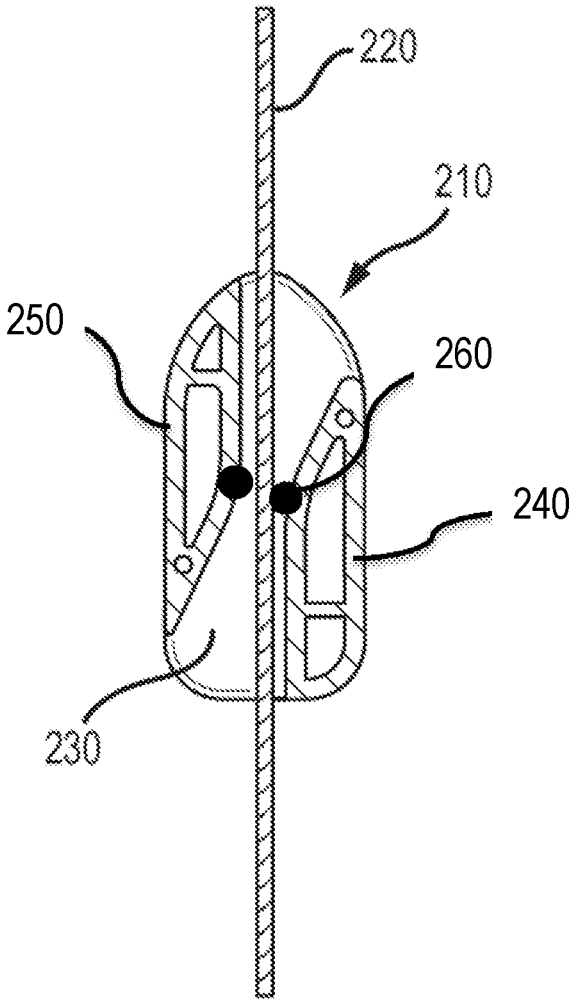
FIG. 7 illustrates a cut-away view of a heavy duty finial having bearings and guide plates, in accordance with various embodiments.

In various embodiments with heavier/larger shades and/or a heavy hembar, finials 210 (as shown in FIG. 6) may be fabricated with stronger materials and processes to better guide the guide cable 220. As shown in FIG. 7, the finials 210 may include a first guide plate 240 and a second guide plate 250, wherein the first guide cable is sandwiched between the first guide plate 240 and the second guide plate 250. Similarly, the other finial 210 on the opposite end of the hembar may include a third guide plate 240 and a fourth guide plate 250, wherein the second guide cable is sandwiched between the third guide plate 240 and the fourth guide plate 250. As also shown in FIG. 7, the finials 210 may include bearings 260 (e.g., in the channels) to minimize wear and tear on larger guide cables 220. Larger guide cables 220 are used to support the heavier shades and/or heavier hembar; however, the larger guide cables 220 may have a rougher surface. Guide cable 220 may be 3/16" diameter, but larger systems may include 1/8"-3/8" diameter cables. The rough surface may not allow the finials to track as smoothly. As such, a bearing or wheel may help smooth the flow of the guide cables 220 and reduce friction. The stronger materials may include molded plastic materials, aluminum, titanium, and/or the like. The finials may also be fabricated using die cast, molded or sintered metallic compositions, or from plastic or metal composites. The bearings may be metal, plastic and/or any combination.

Figure 5:
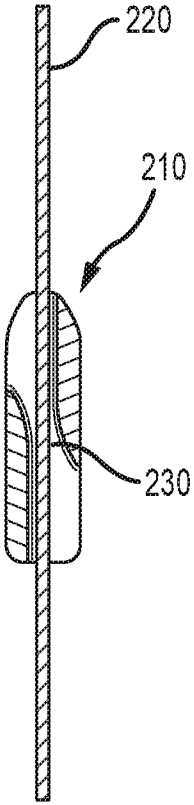
FIG. 5 illustrates a cut-away view of the finial in FIGS. 2-4, in accordance with various embodiments.

The external opening 225 on the second side of finial 210 may be a slot or channel that is angled, curved and/or "S"-shaped. The angled channel may be at any angle. After installation, the angled slot is not parallel to the guide cable 220. The channel may be wider than the guide cable 220. Guide cable 220, even when taut and straight, may be received into the angled opening. The first side of hembar 200 and/or finial 210 may be rotated or twisted to allow guide cable 220 to align with the opening, such that guide cable 220 is reciprocally received into the opening. Guide cable 220 may be reciprocally received into the opening without the need to bend guide cable 220 or un-attach guide cable 220. Hembar 200 and/or finial 210 may be rotated back to allow guide cable 220 to sit within an internal vertical channel 230, as shown in FIG. 5. After inserted, guide cable 220 may be mis-aligned with the angled opening such that guide cable 220 may freely translate along the internal vertical channel 230, but be restricted from exiting the angled opening.

The removal of the guide cable 220 may not occur naturally because the second side of the hembar 200 may have a similar or identical finial 210. Being on the other side, the same finial 210 would have the angled opening/channel facing the opposite direction (e.g., mirror image). As a result, rotating the first side of the hembar 200 in one direction will cause the second side of hembar 200 to twist in the same direction. However, the finial 210 on the second side of hembar 200 will oppose that twist. In other words, hembar 200 twists unnaturally in opposing directions to insert/remove guide cable 220, which helps naturally "lock" hembar 200 in place. The hembar is rotated in two different directions to remove the shade from guide cables 220.

In various embodiments, hembar 200 may not exist or exist in other forms. For example, the finials 200 may attach to the sides of the roller shade fabric at any location. In various embodiments, the finials 200 may attach to the sides of the roller shade fabric at or near the end of the shade material (i.e., the end that is un-wound from the roller).

Guide cable 220 may be removably or permanently attached to an upper area (e.g., above a shade) and a lower area (e.g., below a shade). The upper area may be a ceiling and a lower area may be the window sill or the floor. Guide cable 220 may be a wire comprised of metal, alloy, fabric, wood, plastic, rope and/or any other material suitable to serve as a guide and be received by finial 210. Moreover, guide cable 220 may not be a cable, but may include any material or any elongated item (e.g., dowel, screw, chain, etc).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. Different cross-hatching may be used throughout the figures to denote different parts but not necessarily to denote the same or different materials. No claim element herein is to be construed under the provisions of 35 U.S.C. 112, sixth paragraph, unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A window shading system comprising:

a hembar coupled to a window shade,
  wherein the hembar has a first end and a second end;

a first finial coupled to the first end of the hembar,
  wherein the first finial has a first longitudinal axis and includes an external first slot angled relative to the first longitudinal axis at a first angle, wherein the first external slot is configured to receive a guide cable, a second finial coupled to the second end of the hembar;
  wherein the second finial has a second longitudinal axis and includes an external second slot angled relative to the second longitudinal axis at a second angle, wherein the external second slot is configured to receive a guide cable, a first guide cable received in the first finial;

a second guide cable received in the second finial;

a first guide plate within the first finial,
  wherein an inner edge of the first guide plate extends next to a first side of the first guide cable to restrict horizontal movement of the first guide cable;

a second guide plate within the first finial,
  wherein an inner edge of the second guide plate extends next to a second side of the first guide cable to restrict horizontal movement of the first guide cable;
  wherein the first guide cable is between the first guide plate and the second guide plate wherein the inner edge of the first guide plate and the inner edge of the second guide plate are substantially parallel and equidistant from the first guide cable;

a third guide plate within the second finial,
  wherein an inner edge of the third guide plate extends next to a first side of the second guide cable to restrict horizontal movement of the second guide cable; and a fourth guide plate within the second finial,
  wherein an inner edge of the fourth guide plate extends next to a second side of the second guide cable to restrict horizontal movement of the second guide cable,
  wherein the second guide cable is between the third guide plate and the fourth guide plate, wherein the inner edge of the third guide plate and the inner edge of the fourth guide plate are substantially parallel and equidistant from the second guide cable.

2. The system of claim 1, wherein the first guide cable is not parallel to the first angle and the second guide cable is not parallel to the second angle.

3. The system of claim 1, wherein the first angle and the second angle are mirror images.

4. The system of claim 1, wherein at least one of the first angle or the second angle are at least one of curved or "S" shaped.

5. The system of claim 1, wherein the first finial includes a wheel impacting a side of the first guide cable.

6. The system of claim 1, wherein the first finial is configured to be removed from the first guide cable, while the first guide cable is still connected at a top end and at a bottom end.

7. The system of claim 1, wherein the first finial includes an outer face plate that contains the external first slot, and wherein a portion of the first guide cable between the first guide plate and the second guide plate is concealed within the first finial and behind the outer face plate.

8. The system of claim 1, wherein the first finial includes an internal first channel between the first guide plate and the second guide plate, wherein the internal first channel is configured to receive the guide cable, wherein the guide cable is configured to translate within the internal first channel.

9. The system of claim 1, wherein the first finial is configured to be twisted a first direction to receive the first guide cable, and wherein the second finial is configured to be twisted a second direction to receive the second guide cable.

10. The system of claim 1, wherein the window shade is at least one of a roller shade, an awning or a roof shade.

11. The system of claim 1, wherein the first finial includes bearings impacting the first side and the second side of the first guide cable.

12. A finial comprising:

an external slot configured to receive a guide cable, wherein the finial has a longitudinal axis and the external slot is angled relative to the longitudinal axis at an angle, wherein the angle is configured to be not parallel to the guide cable, after the guide cable is installed, wherein the external slot is on a first side of the finial;

wherein a second side of the finial is coupled to a hembar;

an internal channel configured to enable the guide cable to translate within and through the internal channel;

a first guide plate within the internal channel, wherein an inner edge of the first guide plate extends next to a first side of the guide cable to restrict horizontal movement of the guide cable; and a second guide plate within the internal channel, wherein an inner edge of the second guide plate extends next to a second side of the guide cable to restrict horizontal movement of the guide cable, wherein the guide cable is between the first guide plate and the second guide plate, and wherein the inner edge of the first guide plate and the inner edge of the second guide plate are substantially parallel and equidistant from the guide cable.

13. The finial of claim 12, wherein the finial includes bearings impacting the first side and the second side of the guide cable.

14. The finial of claim 12, wherein the finial is configured to be removed from the guide cable, while the guide cable is still connected at a top end and at a bottom end.

15. The finial of claim 12, wherein the finial includes an outer face plate that contains the external first slot, and wherein a portion of the guide cable between the first guide plate and the second guide plate is concealed within the finial and behind the outer face plate.

16. The finial of claim 12, wherein the finial is configured to be twisted a first direction to receive the guide cable.

17. A method for inserting a first guide cable into a first finial and a second guide cable into a second finial, the method comprising:

rotating a hembar a first angle to align an external first slot of the first finial with the first guide cable, wherein the first finial has a first longitudinal axis and the external first slot is angled relative to the first longitudinal axis at the first angle, wherein the first finial is on a first end of the hembar;

receiving the first guide cable through the external first slot;

reverse rotating the hembar to align the first guide cable with a first internal channel inside the first finial, wherein a first guide plate is within the first internal channel, wherein an inner edge of the first guide plate extends next to a first side of the first guide cable to restrict horizontal movement of the first guide cable, wherein a second guide plate is within the first internal channel, wherein an inner edge of the second guide plate extends next to a second side of the first guide cable to restrict horizontal movement of the first guide cable, wherein the first guide cable is between the first guide plate and the second guide plate, and wherein the inner edge of the first guide plate and the inner edge of the second guide plate are substantially parallel and equidistant from the first guide cable;

rotating the hembar a second angle to align an external second slot of the second finial with the second guide cable;

wherein the second finial has a second longitudinal axis and the external second slot is angled relative to the second longitudinal axis at the second angle, wherein the second finial is on a second end of the hembar;

receiving the second guide cable through the external second slot; and reverse rotating the hembar to align the second guide cable with a second internal channel inside the second finial, wherein a third guide plate is within the second internal channel, wherein an inner edge of the third guide plate extends next to a first side of the second guide cable to restrict horizontal movement of the second guide cable, wherein a fourth guide plate is within the second internal channel, wherein an inner edge of the fourth guide plate extends next to a second side of the second guide cable to restrict horizontal movement of the second guide cable, wherein the second guide cable is between the third guide plate and the fourth guide plate, and wherein the inner edge of the third guide plate and the inner edge of the fourth guide plate are substantially parallel and equidistant from the second guide cable.

* * * * *